US007506592B2

(12) United States Patent
Rossini

(10) Patent No.: US 7,506,592 B2
(45) Date of Patent: Mar. 24, 2009

(54) ADJUSTABLE HEIGHT WORKSTATION FOR LAPTOP OR TABLET COMPUTERS

(75) Inventor: Alfred P. Rossini, Southboro, MA (US)

(73) Assignee: Jaco, Inc., Franklin, MA (US)

( * ) Notice: Subject to any disclaimer, the term of this patent is extended or adjusted under 35 U.S.C. 154(b) by 528 days.

(21) Appl. No.: 10/923,638

(22) Filed: Aug. 20, 2004

(65) Prior Publication Data

US 2005/0045072 A1 Mar. 3, 2005

Related U.S. Application Data

(60) Provisional application No. 60/498,055, filed on Aug. 27, 2003.

(51) Int. Cl.
*A47B 37/00* (2006.01)

(52) U.S. Cl. ..... 108/50.01; 108/93; 108/147

(58) Field of Classification Search ..... 108/50.01, 108/50.02, 93, 106, 108, 147; 312/208.1, 312/208.2, 208.3, 223.3, 235.9, 249.9, 249.11
See application file for complete search history.

(56) References Cited

U.S. PATENT DOCUMENTS 5,131,333 A * 7/1992 Karasawa et al. ..... 108/7
5,778,799 A * 7/1998 Eyre ..... 108/50.01
5,806,943 A * 9/1998 Dell et al. ..... 312/223.3
6,038,986 A * 3/2000 Ransil et al. ..... 108/145
6,394,402 B2 * 5/2002 Coonan et al. ..... 248/123.11
6,493,220 B1 * 12/2002 Clark et al. ..... 312/223.3
6,691,626 B2 * 2/2004 Warner ..... 108/145
6,823,802 B2 * 11/2004 Butts, Jr. ..... 108/50.01
6,883,439 B1 * 4/2005 Moore ..... 108/147
2003/0037709 A1 * 2/2003 Kolavo ..... 108/50.01
2003/0085639 A1 * 5/2003 Ming-Hwa ..... 312/223.3
2005/0035198 A1 * 2/2005 Wilensky ..... 235/383

FOREIGN PATENT DOCUMENTS

CH 614364 * 11/1979
EP 321137 * 6/1989

* cited by examiner

*Primary Examiner*—Hanh V Tran
(74) *Attorney, Agent, or Firm*—Brian M. Dingman; Mirick, O'Connell, DeMallie & Lougee, LLP

(57) ABSTRACT

An adjustable-height workstation that can hold a laptop or tablet computer. The workstation includes a base section, an intermediate section having an upwardly-extending lower support structure, an upper support structure, and a pair of parallel side links connected there between, to accomplish a double-crank parallelogram four-bar linkage, with the upper support structure defining the coupler of the linkage. The workstation also has an upper working section supported by the intermediate section and having at least a first essentially horizontal shelf, to provide an adjustable-height workspace.

17 Claims, 7 Drawing Sheets

ADJUSTABLE HEIGHT WORKSTATION FOR LAPTOP OR TABLET COMPUTERS

CROSS REFERENCE TO RELATED APPLICATION

This application claims priority of Provisional application Ser. No. 60/498,055, filed on Aug. 27, 2003.

FIELD OF THE INVENTION

This invention relates to a mobile workstation for a laptop or tablet computer.

BACKGROUND OF THE INVENTION

Mobile carts used as workstations are known. These carts are commonly used in medical facilities and on manufacturing floors. They are typically adapted to carry a computer, and usually have additional shelf space available for the user, for such things as paper work, medications, and/or portable medical equipment.

These carts are typically used by many different people over the course of a day or a week. It is thus important that these carts have certain ergonomic features. For example, it is desirable for the user to be able to adjust the height of the cart to place the work surfaces and computer at a convenient and comfortable position. It is typically also important for the display portion of the computer to be adjustable for optimal viewing.

Such carts typically comprise a wheeled base and an upper working section connected by an adjustable-length post, which is typically accomplished with a gas spring. The spring is operated by a lever. As there can be a substantial amount of weight carried at the top of the post, it is awkward and relatively difficult to lift the working section to a higher working position. This has been especially problematic in medical facilities, as often times the users of these carts are female nurses who lack the strength to easily lift the working section to a comfortable working height. The height-adjustment feature is thus less likely to be properly employed by such users.

SUMMARY OF THE INVENTION

This invention features an adjustable-height workstation that has sufficient workspace, and typically is particularly adapted to hold a laptop or tablet computer. The workstation includes a base section, and an intermediate section having an upwardly-extending lower support structure, an upper support structure, and a pair of parallel side links connected there between, to accomplish a double-crank parallelogram four-bar linkage, with the upper support structure defining the coupler of the linkage. The workstation also has an upper working section supported by the intermediate section and having at least a first essentially horizontal shelf, to provide an adjustable-height workspace.

The intermediate support section may further comprise a spring coupled between at least one of the side links and the lower support structure, to assist in movement of the upper support structure relative to the lower support structure. The spring may be a gas spring. The base section may comprise a plurality of wheels that rest on the floor, to accomplish a mobile workstation. The wheels may be locking casters.

The upper section may further comprise a second essentially horizontal shelf spaced from and below the first shelf. The second shelf may be hingedly connected to the first shelf. The upper section may further comprise one or more standoffs between the first and second shelves. The hinged connection may be located where the standoffs contact the second shelf.

The upper section may further comprise a mechanical structure coupled to the first shelf and extending between the two shelves and above and near one side of the first shelf, to create space for a device to fit between the shelves. The device may be a portion of a computing device. The computing device may be a laptop computer, in which case the device that fits between the shelves may be the display portion of the laptop computer. The laptop computer may also have a base portion to which the display portion is hingedly attached; the base portion sits on the first shelf.

The mechanical structure may comprise a bar that rests on the second shelf. The bar may be releasably couplable to the second shelf. The releasable coupling may be accomplished with a tab attached to the bar that fits through a slot in the second shelf. The tab may have an opening located below the second shelf when the tab is fitted through the slot, to allow a lock to be placed through the tab, to prevent the first shelf from being lifted off the second shelf. The bar may define two projecting lobes extending above the first shelf. The bar may further define an intermediate section between the lobes that extends down to the second shelf.

The adjustable-height workstation may further comprise at least one receptacle for holding a battery or other power source. The adjustable-height workstation may comprise at least two such receptacles. A receptacle may be coupled to the upper section, and carry a battery for powering a computer. The upper section may further comprise a tray for a computer keyboard. The tray may be extendable and retractable relative to the first shelf. The tray may comprise a retractable mouse-holding portion.

The upper section may further comprise a tablet computer holder. The tablet computer holder may comprise one or more structures that releasably capture the tablet computer. The tablet computer holder may comprise structures that overly at least three edges of the tablet computer when the tablet computer is on the tablet computer holder. A structure that releasably captures the tablet computer may comprise a movable protruding section that can be moved to overly an edge of the tablet computer. The tablet computer holder may further comprise a device for locking the protruding section in place while it overlies the edge of the tablet computer.

Also featured in the invention is an adjustable height workstation comprising a base section having a plurality of wheels that rest on the floor, to accomplish a mobile workstation. There is an intermediate section comprising an upwardly-extending lower support structure, an upper support structure, and a pair of parallel side links connected there between, to accomplish a double-crank parallelogram four-bar linkage, with the upper support structure comprising the coupler of the linkage, and further comprising a gas spring coupled between at least one of the side links and the lower support structure, to assist in movement of the upper support structure relative to the lower support structure. Also included is an upper working section supported by the intermediate section and comprising at least a first essentially horizontal shelf, to provide an adjustable-height workspace. The upper section may further comprise a tablet computer holder comprising structures along four sides, at least some of which overly at least two of the four edges of the tablet computer, to releasably capture the tablet computer. At least one such structure may comprise a movable protruding section that can be moved to overly an edge of the tablet computer, the tablet computer holder further comprising a device for locking this movable protruding section in place while it overlies the edge of the tablet computer.

BRIEF DESCRIPTION OF THE DRAWINGS

Other objects, features and advantages will occur to those skilled in the art from the following description of the preferred embodiments and the accompanying drawings in which.

DESCRIPTION OF THE PREFERRED EMBODIMENTS

Figure 1A:
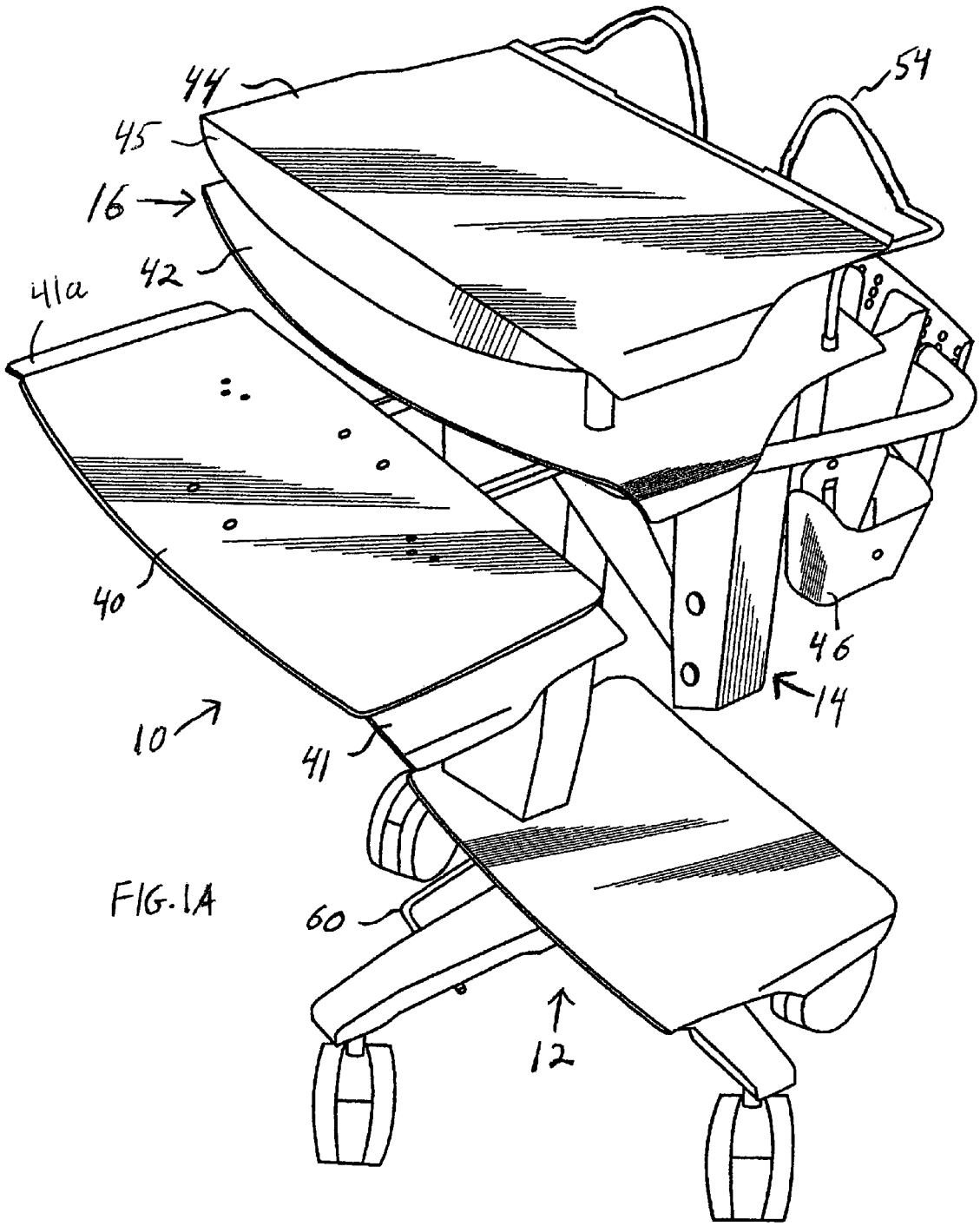
FIGS. 1A through 1C are perspective, rear and side views, respectively, of a preferred embodiment of the adjustable-height workstation of this invention.

This invention comprises a wheeled mobile cart that is particularly adapted to hold either a laptop computer or a tablet computer. The cart defines an upper working surface. The height of the upper working surface relative to the wheeled base is user-adjustable to accommodate a particular user or use. FIGS. 1A-1E show one embodiment adapted to carry a laptop computer, with FIG. 2 showing a variation thereof. FIG. 3 shows a second embodiment adapted to carry a tablet computer.

Wheeled mobile cart 10, FIGS. lA-lE, comprises three main parts: wheeled base 12, adjustable-height intermediate support section 14, and upper working section 16. Base 12 comprises structure 20 that carries a plurality of locking casters 21. Intermediate section 14 comprises lower generally vertical support structure 30 and upper generally vertical support structure 34, connected by linkage 32. Linkage 32 comprises a pair of pivotable parallel side links that allow structure 34 to move relative to structure 30, while maintaining the generally parallel relationship between structures 30 and 34 so that upper working section 16 is maintained in the horizontal position as it is moved up-and-down via linkage mechanism 32. Mechanism 32 is operated by the user via foot lever 60. Depressing foot lever 60 releases mechanism 32, which will move down under the force of gravity, and can be lifted up by the user. When the user's foot is taken off lever 60, mechanism 32 locks again. The adjustment mechanism preferably includes gas spring 33 and foot lever 60. Gas spring 33 is coupled to the lower link of the double pivoting link arrangement 32. These links are pivotable about horizontal axes relative to structures 30 and 34 to maintain structure 34 vertical, and thus maintain upper working section 16 in the horizontal position as it is moved up and down.

Upper section 16 comprises at a minimum a support surface for a laptop computer. In this embodiment, section 16 comprises support shelf 42 and/or 44 for a laptop computer, and forwardly-projecting retractable shelf 40 that is adapted to hold a computer keyboard. In a typical use, a laptop computer is inserted in the space between the back of upper shelf 44 and rear bar 54 with the keyboard portion of the laptop computer resting on shelf 42. Upper section 16 also includes one or more standoffs 92 between shelf 42 and shelf 44.

Shelf 44 is attached to shelf 42 through a hinge assembly 93 that allows shelf 44 and bar 54 to pivot relative to shelf 42. A laptop computer can then be placed on surface 42. Shelf 44 can then be lowered back down so that it rests on surface 42 as shown. Bar 54 is releasablv couDled to shelf 42 with a tab 63*a* that is attached to bar 54. Tab 63*a* fits through a slot in shelf 42. Tab 63*a* has an onenin2 located below shelf 42 when tab 63*a* is fitted through the slot, to allow a lock (not shown) to be Dlaced through tab 63*a*. to Drevent shelf 44 to being lifted off shelf 42. The display portion of the laptop projects upward just in front of bar 54, so that it is visible to the user. A padlock (not shown) is used to secure bar 54 to surface 42 to prevent unwanted removal of an installed laptop. The shape of bar 54, with spaced protruding lobes 54*a* and 54*b* extending above the top of shelf 44, prevents removal of a laptop computer through opening 106 between back 44*a* of shelf 44 and bar 54. Lobes 54*a* and 54*b* also act as a back rest for the display portion 104 of laptop computer 102.

In this usage scenario, the user does not have access to the keyboard portion of the laptop. However, a keyboard can be placed on retractable tray 40 and connected to the laptop so that the user can perform keyboard functions. Retractable mouse portion 41 extends from tray 40 to provide a convenient location for a mouse, if one is used. This arrangement also provides upper working surface 44 that can be used as desired, typically as a small desk surface on which the user can place items, or write. In an alternative usage, the user can place the laptop on surface 44 and just use the laptop normally.

Receiver saddle 46 is adapted to carry a typical laptop battery or AC/DC converter so that the laptop can be plugged into a wall receptacle AC power source. Rear carrier 48 can accept a flat battery cell that can be used to extend wireless run time.

Figure 1B:
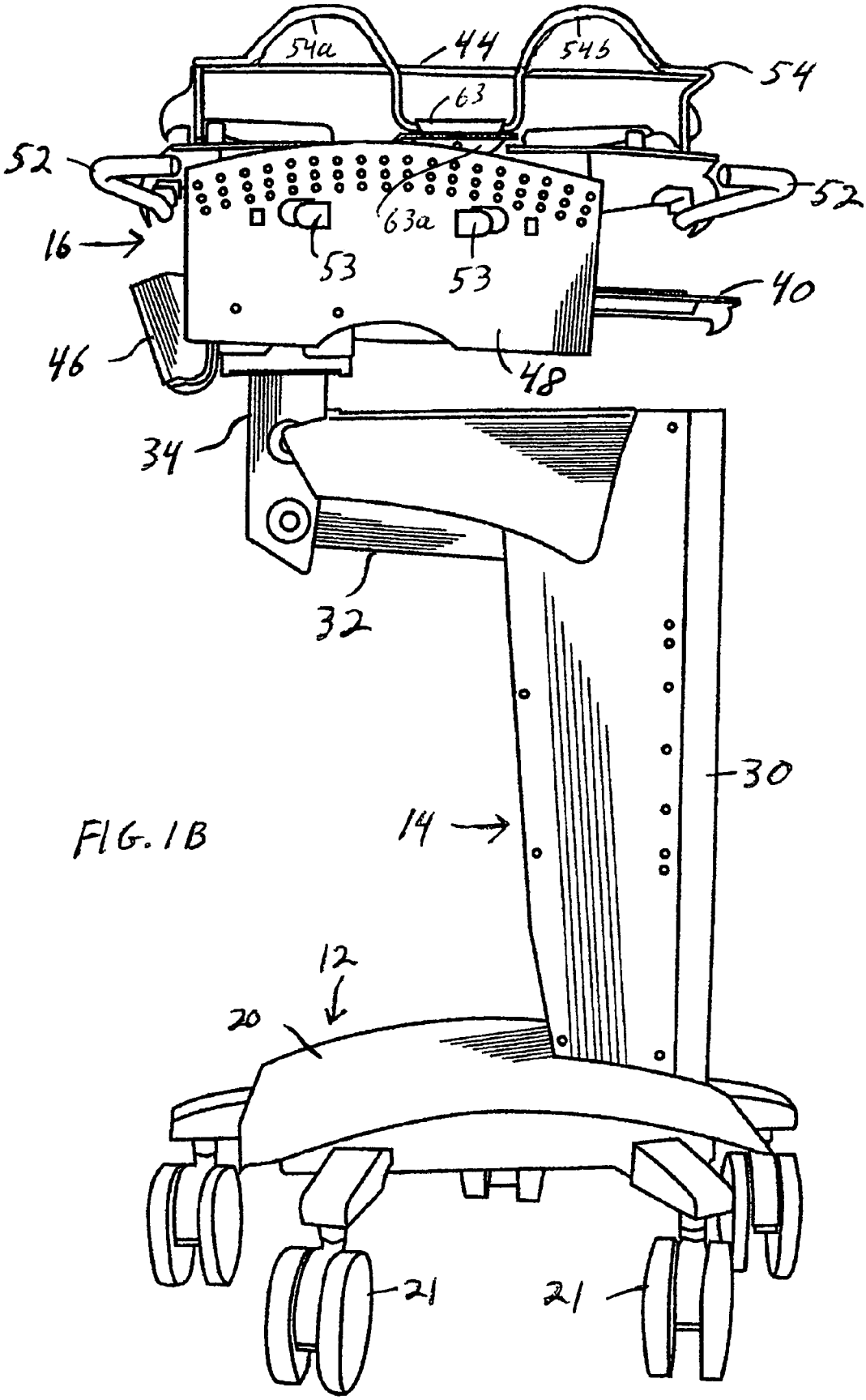
Figure 1C:
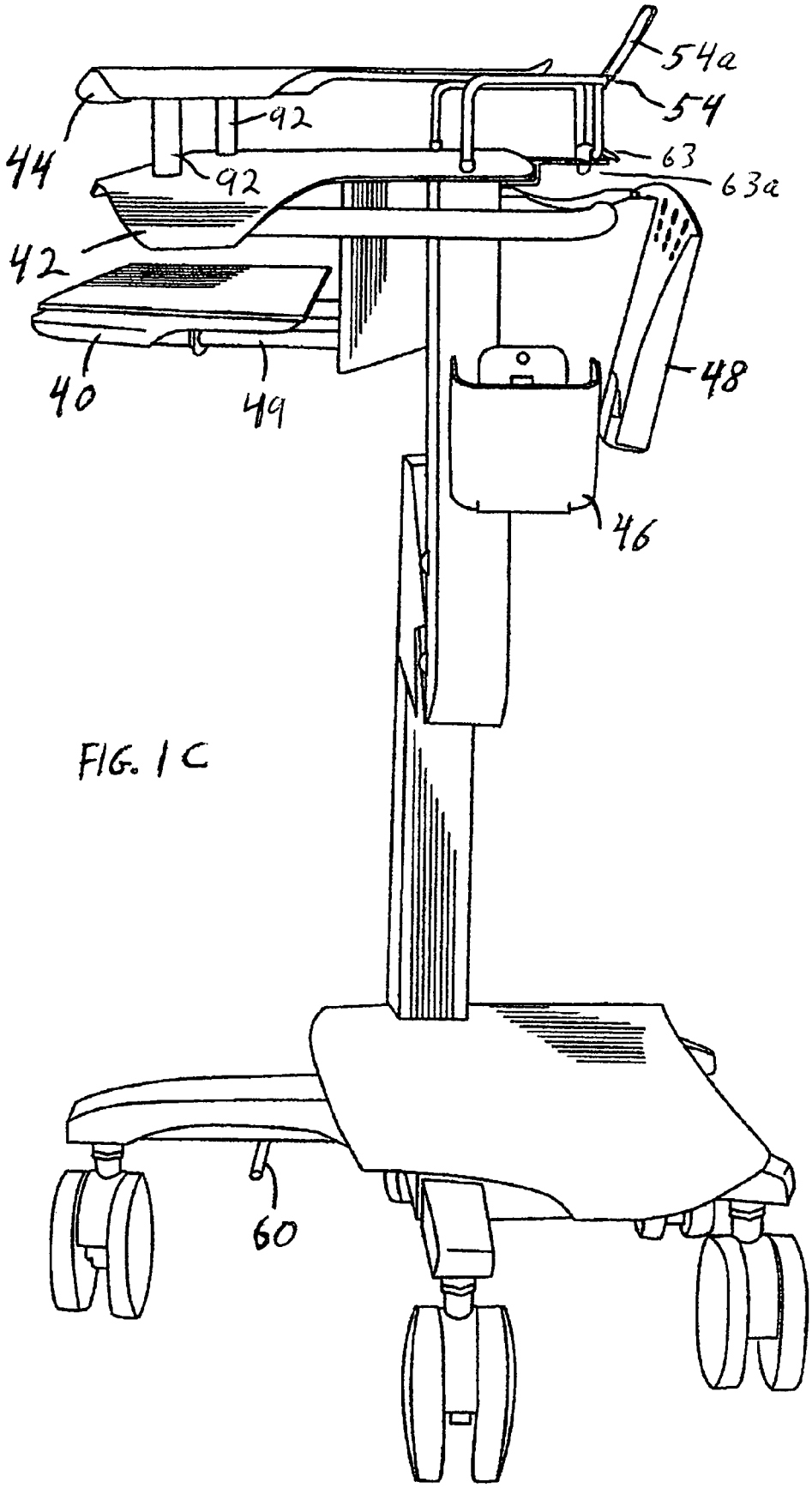
Figure 1E:
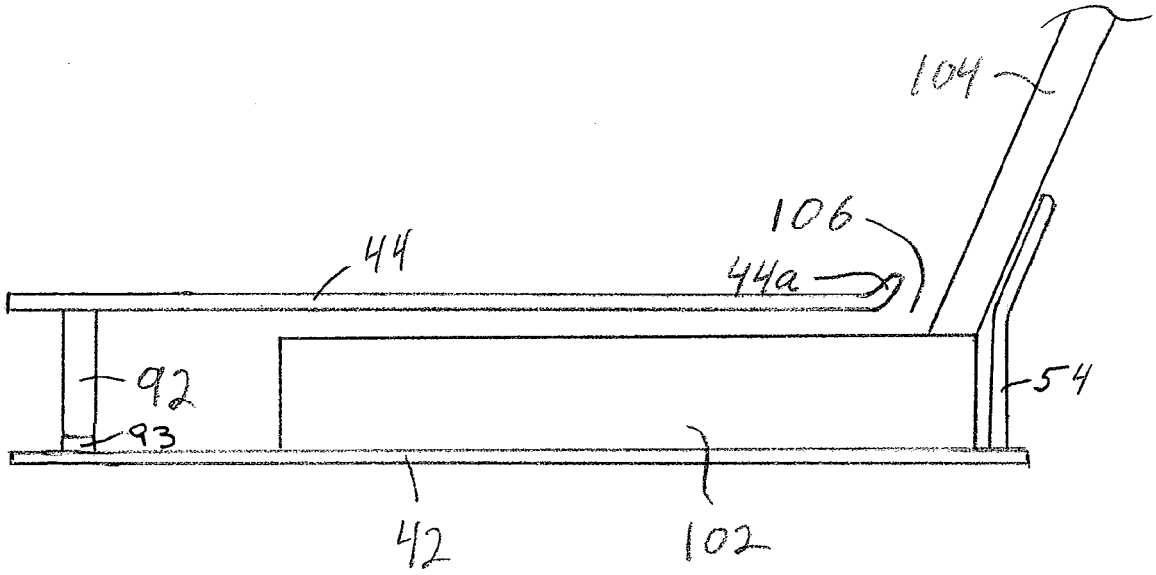
FIG. 1E is a close-up schematic side view of a laptop computer in use on the workstation of FIGS. 1A through 1C.
Figure 1D:
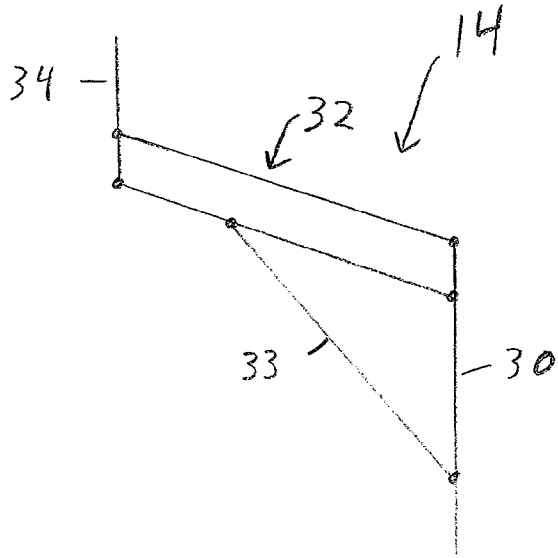
FIG. 1D is a highly schematic view of the four-bar linkage and the gas spring of the embodiment of FIGS. 1A-1C.
Figure 2:
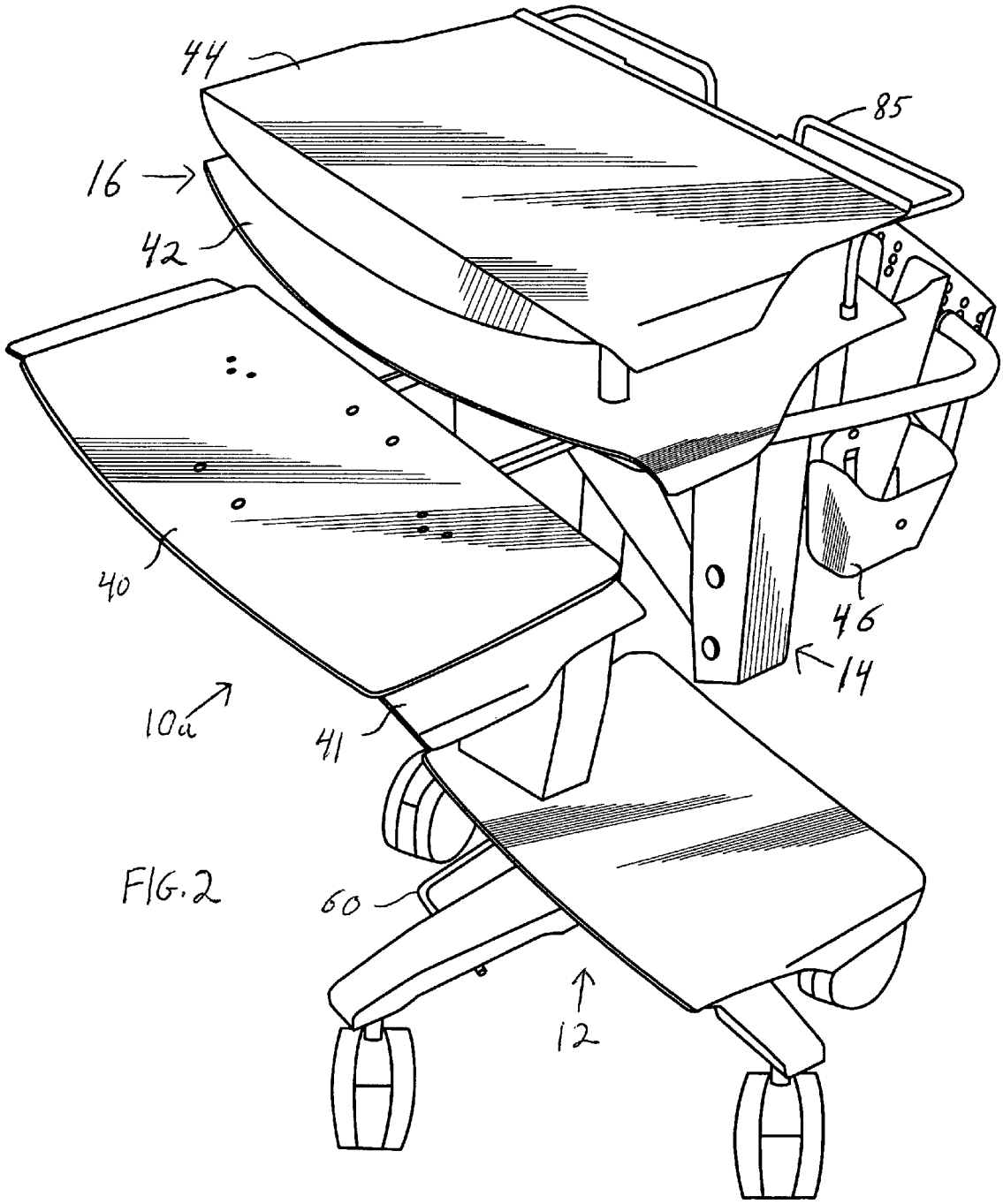
FIG. 2 is a view similar to that of FIG. 1A but of a slightly different embodiment of the invention.

The embodiment shown in FIG. 2 is identical to that of FIG. 1, except that bar 85 is straight as opposed to the "M" shape of bar 54, FIGS. 1A-1C.

Figure 3A:
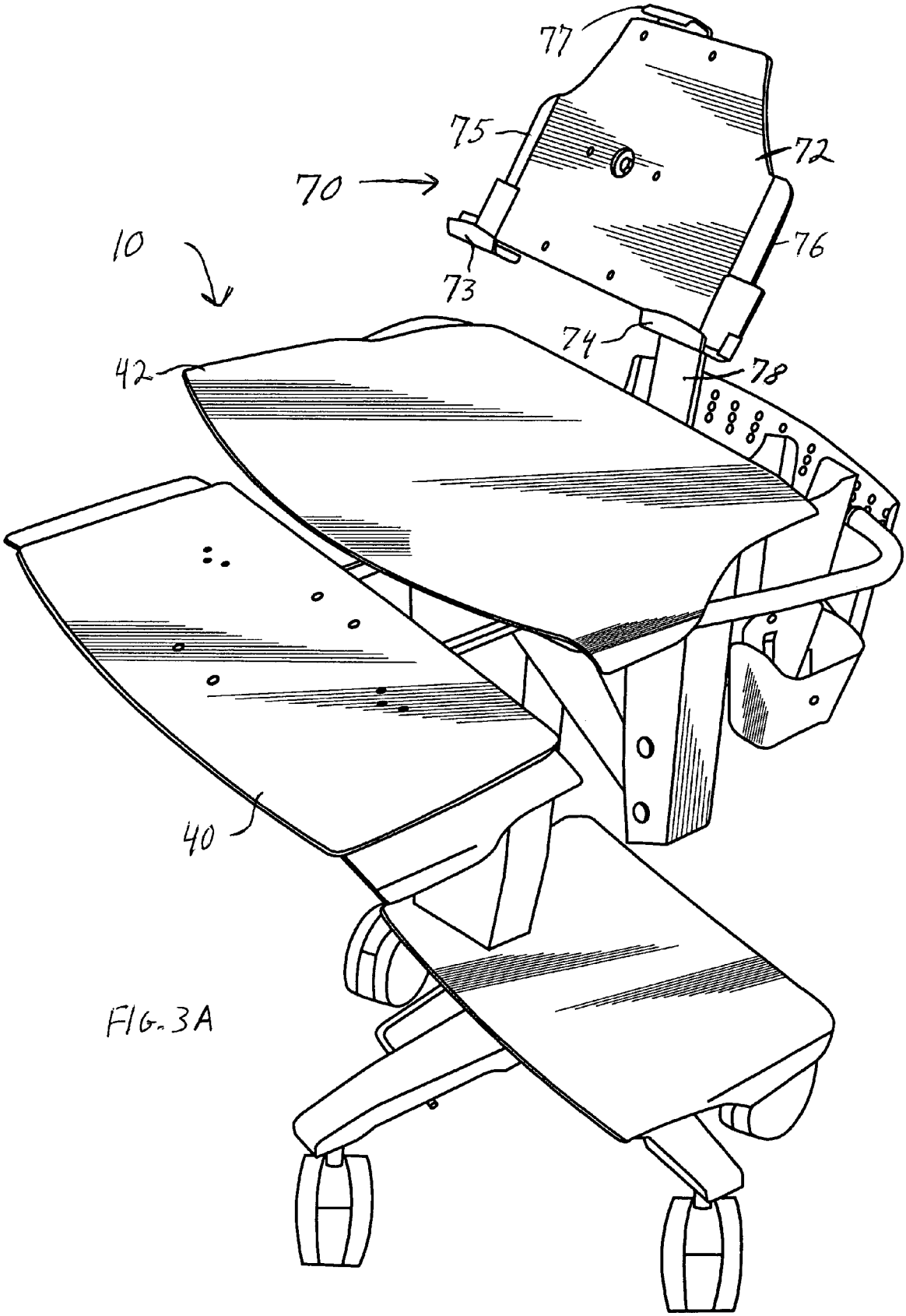
FIG. 3A is a perspective view of another alternative preferred embodiment of the invention that is particularly adapted to carry a tablet computer.
Figure 3B:
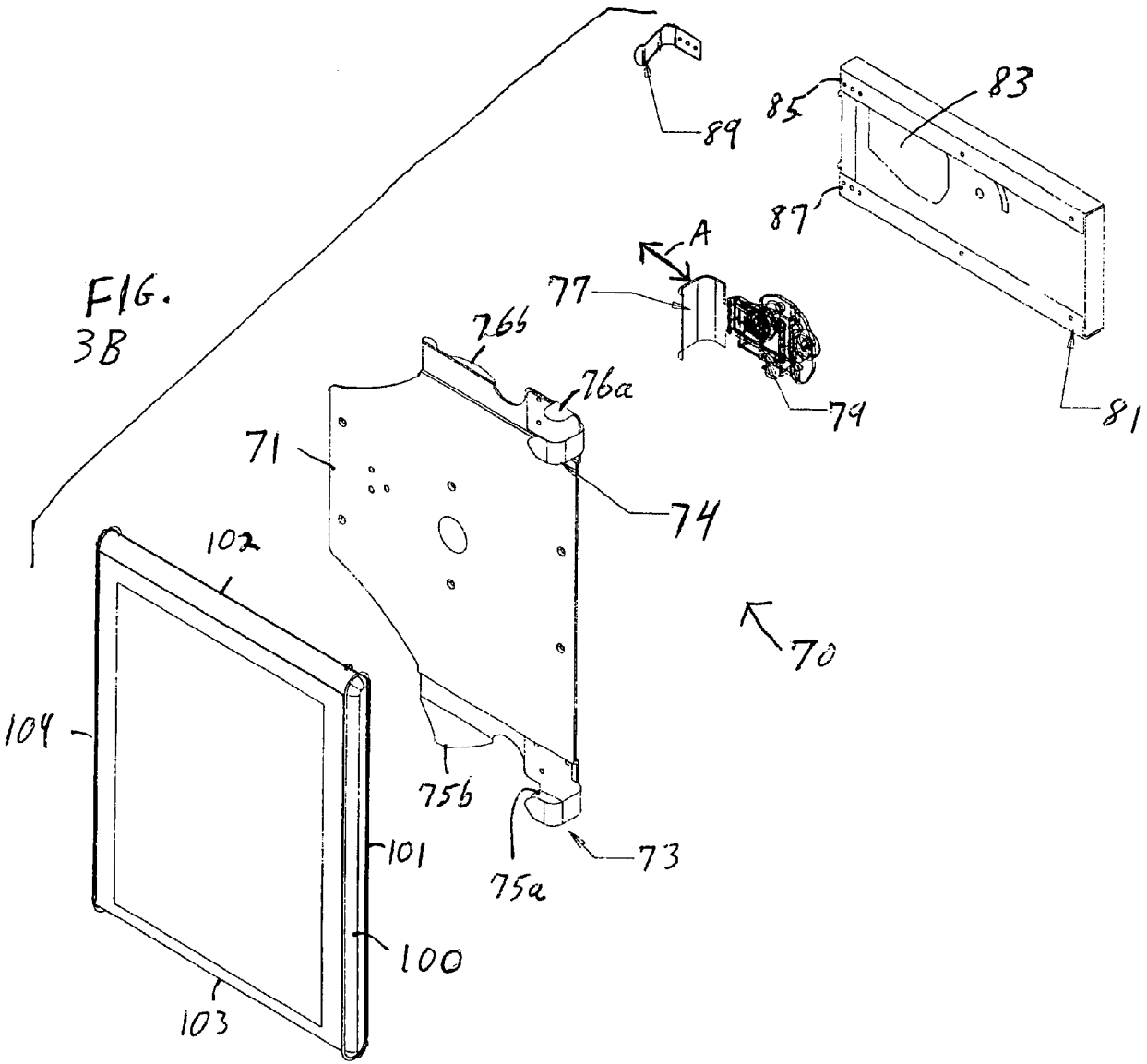
FIG. 3B is an exploded view of the preferred mechanism for accomplishing a locking tablet computer cradle for the embodiment of FIG. 3A.

Embodiment 10*a*, FIGS. 3A and 3B, does not include upper working surface 44 or bar 54 or 85. Rather, tablet computer holder 70 is coupled to the cart via support 78. Holder 70 defines receiving sections 73 and 74 that grip one edge of the tablet computer, and projecting edge-receiving sections 75 and 76. In order to grip tablet computers of different widths, sections 73 and 74 can be sized and shaped as necessary for a particular model of tablet computer. Sections 73-76 all overlay the top of three sides of the tablet computer. Upper grip 77 preferably has a forward-most downwardly protruding tab section that overlays the front edge of the tablet so that the tablet cannot be removed from the holder once inserted therein. Upper support 77 is attached to a rotating lock that, when unlocked, can be rotated, causing the C-shaped clamp 77 to move up, and thus free the upper edge of the tablet, so that it can be removed. Backing 72 is preferably pivotably coupled to support 78 so that the user can adjust the angle of the display for the particular user or use situation, and also to allow a 90 degree rotation, to provide for both portrait and landscape viewing.

The preferred embodiment of this tablet computer cradle is shown in exploded view in FIG. 3B. Tablet computer 100 has sides 101 through 104. Cradle 70 comprises first sheet metal member 71, second sheet metal member 81, lock 79 that operates movable arm 77, and two spring arm gripping and support brackets 89 (only one shown) that are coupled to member 81 at locations 85 and 87. Lock 79 sits in opening 83 in member 81. "C" shaped locking and support arm 77 is moved back and forth in the direction of arrow A as a key turns a lock in locking mechanism 79. This can be accomplished by coupling arm 77 to a pawl moved by locking mechanism 79. Member 71 defines the tablet support base and also fixed retaining arms 73 and 74 against which side 101 of computer 100 sits, fixed projecting arms 76*a* and 76*b* against which side 102 sits, and fixed projecting arms 75*a* and 75*b* against which side 103 sits. At least retaining arms 73 and 74 overlay a portion of the top of the tablet computer. Fixed projecting arms on three sides of the tablet PC prevent the tablet from substantially moving from side-to-side and also overlay the top edge of the tablet at least on one side, so that the tablet PC must be removed from the cradle by sliding it in and out from side 104. Movable retaining arm 77 is able to move out away from the tablet (in the direction of arrow A) a sufficient distance so that the tablet can be removed from the cradle. Once the tablet is slid into the cradle, the key is used to turn the lock that pulls arm 77 back in against side 104 and overlaying the top, to snuggly hold the tablet and also lock the tablet in the cradle to prevent the tablet PC from being misplaced or stolen.

Although specific features of the invention are shown in some drawings and not others, this is for convenience only, as the features can be combined as would be apparent to those skilled in the art, and as the claims set forth the rights granted under the patent. Other combinations of features would be apparent to those skilled in the field and are within the scope of the claims.

What is claimed is:

1. An adjustable height workstation for use by a user that can hold a laptop or tablet computer, the workstation comprising:

a base section;

an intermediate section coupled to the base section and comprising an upwardly-extending lower support structure, an upper support structure, and a pair of parallel side links connected there between, to accomplish a double-crank parallelogram four-bar linkage;

a spring having a first end coupled to the lower support structure and a second end coupled to one of the parallel side links, to assist in movement of the upper support structure relative to the lower support structure; and an upper working section supported by the intermediate section and comprising:

a first essentially horizontal shelf having a front edge for positioning adjacent to the user, a back edge opposite the front edge, and first and second opposite side edges, a second essentially horizontal shelf having a front edge for positioning adjacent to the user, a back edge opposite the front edge, and first and second opposite side edges, the second shelf spaced from and below the first shelf, a plurality of standoffs, wherein each of the standoffs is coupled at a first end to the first shelf at locations proximate the front edge of the first shelf, and hingedly coupled at a second end to the second shelf at locations proximate the front edge of the second shelf, wherein the hinged coupling is adapted to allow the user to tilt the first shelf away from the second shelf and relative to the back edge of the second shelf, and a mechanical structure releasably coupled to the second shelf and extending between the two shelves and above and near one side of the second shelf, to create a space for at least a portion of the laptop or tablet computer to fit between the shelves, wherein the mechanical structure defines at least one projecting lobe extending above the first shelf, the lobe configured to support a display portion of the laptop or tablet computer, and wherein the releasable coupling is accomplished with a tab attached to the mechanical structure that fits through a slot in the second shelf to provide an adjustable-height workspace.

2. The adjustable-height workstation of claim 1, wherein the spring compnses a gas spring.

3. The adjustable-height workstation of claim 1, wherein the base section comprises a plurality of wheels that rest on the floor, to accomplish a mobile workstation.

4. The adjustable-height workstation of claim 3, wherein the wheels comprise locking casters.

5. The adjustable-height workstation of claim 1, wherein the mechanical structure creates a space for at least a keyboard portion of the laptop or tablet computer to fit between the shelves.

6. The adjustable-height workstation of claim 5, wherein the the second shelf is configured to support at least the keyboard portion of the laptop or tablet computer, where a display portion of the laptop or tablet computer is hingedly attached to the keyboard portion of the laptop or tablet computer.

7. The adjustable-height workstation of claim 1, wherein the mechanical structure comprises a bar that sits on the second shelf.

8. The adjustable-height workstation of claim 1, wherein the tab has an opening located below the second shelf when the tab is fitted through the slot, to allow a lock to be placed through the tab, to prevent the first shelf from being lifted off the second shelf.

9. The adjustable-height workstation of claim 7, wherein the bar defines two projecting lobes extending above the first shelf.

10. The adjustable-height workstation of claim 9, wherein the bar further defines an intermediate section between the lobes that extends down to the second shelf.

11. The adjustable-height workstation of claim 1, further comprising at least one receptacle for holding a battery or other power source.

12. The adjustable-height workstation of claim 11, comprising at least two such receptacles.

13. The adjustable-height workstation of claim 11, wherein the at least one receptacle is coupled to the upper section, and carries a battery for powering a computer.

14. The adjustable-height workstation of claim 1, wherein the upper section further comprises a tray for a computer keyboard.

15. The adjustable-height workstation of claim 14, wherein the tray is extendable and retractable relative to the first shelf.

16. The adjustable-height workstation of claim 15, wherein the tray comprises a retractable mouse-holding portion.

17. An adjustable height workstation for use by a user that can hold a laptop or tablet computer, the workstation comprising:

a base section comprising a plurality of wheels that rest on the floor, to accomplish a mobile workstation;

an intermediate section coupled to the base section and comprising an upwardly-extending lower support structure, an upper support structure, and a pair of parallel side links connected there between, where the pair of parallel side links comprises an upper member and a lower member, to accomplish a double-crank parallelogram four-bar linkage, and further comprising a gas spring having a first end coupled to the lower support structure and a second end coupled to the lower member of the parallel side links, to assist in movement of the upper support structure relative to the lower support structure;

an upper working section supported by the intermediate section and comprising:

a first essentially horizontal shelf having a front edge for positioning adjacent to the user, a back edge opposite the front edge, and first and second opposite side edges, a second essentially horizontal shelf having a front edge for positioning adjacent to the user, a back edge opposite the front edge, and first and second opposite side edges, the second shelf spaced from and below the first shelf, a plurality of standoffs, wherein each of the standoffs is coupled at a first end to the first shelf at locations proximate the front edge of the first shelf, and hingedly coupled at a second end to the second shelf at locations proximate the front edge of the second shelf, wherein the hinged coupling is adapted to allow the user to tilt the first shelf away from the second shelf relative to the back edge of the second shelf, a bar having one or more protruding lobes, wherein the bar is releasably coupled to the second shelf at a location proximate the back edge of the second shelf and extends between the two shelves and above and proximate the back edge of the first shelf, to create a space for the laptop or tablet computer to fit between the shelves, wherein the releasable coupling is accomplished with a tab attached to the bar that fits through a slot in the second shelf and wherein the one or more protruding lobes prevent the removal of the laptop or tablet computer from the space between the shelves; and a foot lever coupled to the linkage, to operate the linkage and to provide an adjustable-height work space.

* * * * *